US010051692B2

(12) United States Patent
Goto et al.

(10) Patent No.: US 10,051,692 B2
(45) Date of Patent: Aug. 14, 2018

(54) HEATING COOKING DEVICE

(75) Inventors: Toshiyuki Goto, Osaka (JP); Hiroyuki Kato, Osaka (JP)

(73) Assignee: SHARP KABUSHIKI KAISHA, Osaka-Shi, Osaka (JP)

( * ) Notice: Subject to any disclaimer, the term of this patent is extended or adjusted under 35 U.S.C. 154(b) by 1233 days.

(21) Appl. No.: 14/236,438

(22) PCT Filed: Jul. 26, 2012

(86) PCT No.: PCT/JP2012/068962
§ 371 (c)(1),
(2), (4) Date: Jan. 31, 2014

(87) PCT Pub. No.: WO2013/018650
PCT Pub. Date: Feb. 7, 2013

(65) Prior Publication Data

US 2014/0144906 A1 May 29, 2014

(30) Foreign Application Priority Data

Aug. 1, 2011 (JP) ..... 2011-168391

(51) Int. Cl.
*H05B 6/64* (2006.01)

(52) U.S. Cl.
CPC ..... *H05B 6/642* (2013.01); *H05B 6/6458* (2013.01); *H05B 2206/043* (2013.01)

(58) Field of Classification Search
CPC . H05B 6/642; H05B 6/6458; H05B 2206/043
(Continued)

(56) References Cited

U.S. PATENT DOCUMENTS 2,908,234 A * 10/1959 Naylor ..... A21B 1/48
126/21 A
3,470,942 A * 10/1969 Hurutate ..... A23B 4/07
165/263

(Continued)

FOREIGN PATENT DOCUMENTS

CN 1455169 A 11/2003
EP 0 463 726 A2 1/1992

(Continued)

OTHER PUBLICATIONS

European Search Report dated Nov. 24, 2015 in counterpart Application No. EP 12819422.2.

(Continued)

*Primary Examiner* — Eric Stapleton
(74) *Attorney, Agent, or Firm* — Birch, Stewart, Kolasch & Birch, LLP

(57) ABSTRACT

In a heating cooking device, a machine chamber is provided adjacent to a heating chamber for housing a food product. An air supply port is provided in a partition wall that separates the heating chamber and the machine chamber. An air supply fan is provided in the machine chamber, for supplying air to the heating chamber through the air supply port. An air supply damper is provided in the machine chamber, for opening and closing the air supply port. A control unit drives the air supply fan and brings the air supply damper into an open state during high-frequency heating of the food product. The control unit brings the air supply damper into a closed state simultaneously with completion of high-frequency heating of the food product or immediately before or immediately after the completion.

7 Claims, 6 Drawing Sheets

(58) Field of Classification Search
USPC ..... 219/757
See application file for complete search history.

(56) References Cited

U.S. PATENT DOCUMENTS 3,681,557 A * 8/1972 Suzuki ..... H05B 6/642 126/190
3,783,219 A * 1/1974 Tateda ..... H05B 6/642 126/198
4,028,520 A * 6/1977 Torrey ..... H05B 6/6405 219/681
4,123,643 A * 10/1978 Burke ..... H05B 6/642 126/273 R
4,131,779 A * 12/1978 Tatsukawa ..... H05B 6/645 126/193
4,201,187 A * 5/1980 Skow ..... F24D 19/1084 110/190
4,221,949 A * 9/1980 Minakawa ..... H05B 6/6432 219/710
4,282,416 A * 8/1981 White ..... H05B 6/6426 126/21 R
4,308,444 A * 12/1981 Takagi ..... H05B 6/642 126/21 R
4,327,274 A * 4/1982 White ..... F24C 15/2042 126/198
4,334,136 A * 6/1982 Mahan ..... D06F 58/04 219/681
4,339,647 A * 7/1982 Inayama ..... F24C 15/322 219/683
4,369,347 A * 1/1983 Shin ..... H05B 6/642 126/21 R
4,403,128 A * 9/1983 Takagi ..... H05B 6/642 126/21 A
4,450,344 A * 5/1984 Sakoda ..... H05B 6/642 110/163
4,463,238 A * 7/1984 Tanabe ..... H05B 6/645 219/685
4,481,396 A * 11/1984 Matsubayashi ..... F24C 15/006 126/21 A
4,510,361 A * 4/1985 Mahan ..... D06F 58/266 219/697
4,533,809 A * 8/1985 Eke ..... H05B 6/645 219/681
4,575,951 A * 3/1986 Eyzaguirre ..... F26B 23/06 34/235
4,591,683 A * 5/1986 Eke ..... H05B 6/6411 126/21 A
4,598,689 A * 7/1986 Eke ..... H05B 6/642 126/21 A
4,608,474 A * 8/1986 Kohka ..... H05B 6/6473 219/681
4,635,610 A * 1/1987 Nakanishi ..... H05B 6/6473 126/15 A
4,705,928 A * 11/1987 Nakanishi ..... F24C 15/322 126/21 A
4,719,940 A * 1/1988 Beavers ..... G05D 16/0663 137/505.39
4,743,728 A * 5/1988 Nagafusa ..... H05B 6/725 126/21 A
4,831,225 A * 5/1989 Ishifuro ..... H05B 6/6411 126/21 A
4,839,486 A * 6/1989 Tanigawa ..... H05B 6/642 219/681
4,874,915 A * 10/1989 Harms ..... A61M 5/445 219/687
4,884,626 A * 12/1989 Filipowski ..... F24C 7/087 165/231
4,900,884 A * 2/1990 Aoki ..... H05B 6/062 219/601
4,900,885 A * 2/1990 Inumada ..... H05B 6/685 219/716
4,920,246 A * 4/1990 Aoki ..... H02M 3/33523 219/716
5,138,185 A * 8/1992 Weinstock ..... H02J 9/062 307/64
5,166,487 A * 11/1992 Hurley ..... F24C 15/322 122/4 R
5,268,547 A * 12/1993 Bessyo ..... H01H 9/226 219/716
5,288,961 A * 2/1994 Shibuya ..... H05B 6/645 126/198
5,302,793 A * 4/1994 Eke ..... H05B 6/642 219/710
5,338,409 A * 8/1994 Heierli ..... B01D 1/0017 159/22
5,491,624 A * 2/1996 Levran ..... H03K 17/08148 363/44
5,674,425 A * 10/1997 Hong ..... H05B 6/6476 126/21 A
5,693,248 A * 12/1997 Kim ..... H05B 6/6447 219/707
5,742,032 A * 4/1998 Eke ..... H05B 6/6473 219/681
5,799,822 A * 9/1998 Rudewicz ..... G07F 9/026 219/678
5,814,794 A * 9/1998 Lim ..... H05B 6/6435 126/21 A
5,981,929 A * 11/1999 Maeda ..... H05B 6/6429 126/299 D
5,982,645 A * 11/1999 Levran ..... H01F 27/2866 307/66
6,013,908 A * 1/2000 Kume ..... H05B 6/6417 219/719
6,111,239 A * 8/2000 Park ..... H05B 6/6455 219/702
6,218,653 B1 * 4/2001 Kang ..... H05B 6/6423 126/299 R
6,278,098 B1 * 8/2001 Han ..... H05B 6/80 126/21 A
6,278,099 B1 * 8/2001 Kang ..... H05B 6/6423 126/21 A
6,333,492 B1 * 12/2001 Graves ..... F24C 7/087 219/411
6,344,637 B2 * 2/2002 Lee ..... G07C 3/04 126/21 A
6,373,039 B2 * 4/2002 Lee ..... G07C 3/04 126/21 A
6,380,715 B1 * 4/2002 Kubo ..... H01M 10/44 320/128
6,433,323 B2 * 8/2002 Kim ..... G07C 3/04 126/21 A
6,528,772 B1 * 3/2003 Graves ..... H05B 6/6482 219/506
6,624,400 B2 * 9/2003 Chun ..... G07C 3/04 219/702
6,696,676 B1 * 2/2004 Graves ..... F24C 7/087 219/492
7,030,349 B1 * 4/2006 Graves ..... H05B 6/6444 219/685
7,133,739 B2 * 11/2006 Williamson ..... H04N 21/25891 219/414
7,461,588 B2 * 12/2008 Head ..... F24C 7/082 219/412
8,173,942 B2 * 5/2012 Wiseman ..... H05B 6/6485 126/198
8,375,849 B2 * 2/2013 Sajjad ..... F24C 15/006 126/193
8,410,411 B2 * 4/2013 Song ..... H05B 6/6423 219/756
2001/0004077 A1 * 6/2001 Lee ..... H05B 6/6423 219/757
2001/0004078 A1 * 6/2001 Lee ..... H05B 6/6473 219/757
2001/0054612 A1 * 12/2001 Kim ..... H05B 6/642 219/757
2002/0014486 A1 * 2/2002 Chun ..... G07C 3/04 219/702
2002/0048369 A1 * 4/2002 Ginter ..... G06F 21/10 380/277

(56) References Cited

U.S. PATENT DOCUMENTS

2003/0024925 A1* 2/2003 Graves ..... H05B 6/6473 219/681
2003/0111459 A1* 6/2003 Nishimura ..... B23K 1/012 219/615
2003/0120972 A1* 6/2003 Matsushima ..... G08B 13/22 714/25
2003/0191719 A1* 10/2003 Ginter ..... H04N 21/8358 705/54
2004/0058706 A1* 3/2004 Williamson ..... H04N 21/25891 455/557
2005/0006382 A1* 1/2005 Hayakawa ..... F24C 15/327 219/682
2005/0125083 A1* 6/2005 Kiko ..... G05B 15/02 700/19
2005/0134469 A1* 6/2005 Odorcic ..... H05B 6/666 340/661
2007/0194015 A1* 8/2007 Kim ..... H05B 6/6473 219/757
2009/0136843 A1* 5/2009 Yamamoto ..... H01M 2/08 429/179
2009/0184104 A1* 7/2009 Hirano ..... F24C 15/322 219/391
2009/0301687 A1* 12/2009 Watts ..... F24J 2/42 165/48.2
2010/0139638 A1* 6/2010 Hargrave ..... F24C 15/008 126/19 R
2011/0011260 A1* 1/2011 Caggiano ..... B01D 53/06 95/91
2011/0056220 A1* 3/2011 Caggiano ..... B01D 53/002 62/94
2011/0296858 A1* 12/2011 Caggiano ..... B01D 53/06 62/94
2013/0036918 A1* 2/2013 Sakane ..... H05B 6/642 99/358
2013/0153569 A1* 6/2013 Ueki ..... F24C 15/006 219/688
2013/0153571 A1* 6/2013 Asami ..... H05B 6/6402 219/757

FOREIGN PATENT DOCUMENTS

GB 2 146 155 A 4/1985
JP 63-050496 U 4/1988
JP 1-159993 A 6/1989
JP 2003-302058 A 10/2003
JP 2005-322558 A 11/2005
KR 10-0778700 B1 11/2007

OTHER PUBLICATIONS

International Search Report issued in PCT/JP2012/068962, dated Aug. 28, 2012.
Written Opinion issued in PCT/JP2012/068962, dated Aug. 28, 2012.

* cited by examiner

HEATING COOKING DEVICE

TECHNICAL FIELD

The present invention relates to a heating cooking device, and particularly to a heating cooking device using a high-frequency wave.

BACKGROUND ART

In a heating cooking device using a high-frequency heating method, a magnetron that generates a high-frequency wave reaches a high temperature, and thus, it is necessary to cool the magnetron by a cooling fan. Usually, a wind delivered from the cooling fan is also used to cool electric components, resin components and the like other than the magnetron.

In the case of high-frequency heating, it is further necessary to ventilate a heating chamber in order to prevent vapor generated from a food product, which is an object to be heated, from being confined in the heating chamber. For ventilation of the heating chamber, air is introduced into the heating chamber through an air supply port, and the air inside the heating chamber is discharged outside the heating chamber through an exhaust port, together with the vapor. The cooling wind having cooled the magnetron is often used to supply the air into the heating chamber (refer to, for example, Japanese Patent Laying-Open No. 2003-302058 (PTD 1)).

CITATION LIST

Patent Document

PTD 1: Japanese Patent Laying-Open No. 2003-302058

SUMMARY OF INVENTION

Technical Problem

Usually, after heating cooking is completed and until a user opens a front door of the heating chamber to take out the food product, an air supply damper provided at the air supply port is maintained in the open state and rotation of the cooling fan is continued, thereby ventilating the heating chamber.

However, if an external power supply stops due to removal of a power supply plug and the like after heating cooking and during the ventilating state (before opening the front door) as described above, the air supply fan stops with the air supply damper maintained in the open state. Therefore, water vapor inside the heating chamber flows through the air supply port to the outside of the heating chamber. As a result, such a problem arises that condensation occurs on the water-vulnerable components such as the electric components cooled by the cooling fan.

Therefore, an object of the present invention is to provide a heating cooking device in which outflow of water vapor from a heating chamber through an air supply port is prevented after completion of heating cooking with a high-frequency wave.

Solution to Problem

A heating cooking device according to one aspect of the present invention includes: a heating chamber; a high-frequency wave generating device; a machine chamber; an air supply port; an air supply fan; an air supply damper; and a control unit. The heating chamber is provided for housing a food product. The high-frequency wave generating device generates a high-frequency wave that heats the food product. The machine chamber is provided adjacent to the heating chamber. The air supply port is provided in a partition wall that separates the heating chamber and the machine chamber. The air supply fan is provided in the machine chamber, for supplying air to the heating chamber through the air supply port. The air supply damper is provided in the machine chamber, for opening and closing the air supply port. The control unit is provided in the machine chamber, for controlling an operation of the high-frequency wave generating device, the air supply fan and the air supply damper. The control unit drives the air supply fan and brings the air supply damper into an open state during high-frequency heating of the food product. The control unit brings the air supply damper into a closed state simultaneously with completion of high-frequency heating of the food product or immediately before or immediately after the completion.

Preferably, the heating cooking device further includes an input unit accepting an instruction for stopping heating of the food product. When receiving the stop instruction at the input unit during high-frequency heating of the food product, the heating cooking device stops the high-frequency wave generating device and brings the air supply damper into the closed state.

Preferably, the heating cooking device further includes: a power supply monitoring unit; and a backup power supply unit. The power supply monitoring unit detects stop of an external power supply and notifies the control unit about the result of detection. The backup power supply unit is capable of supplying power for a prescribed time period, when the external power supply is stopped. When receiving the notification from the power supply monitoring unit because the external power supply is stopped during high-frequency heating of the food product, the control unit brings the air supply damper into the closed state by power supply from the backup power supply unit.

Preferably, the high-frequency wave generating device is provided in the machine chamber. Wind delivered from the air supply fan is used to cool the high-frequency wave generating device, and the wind having cooled the high-frequency wave generating device is introduced into the heating chamber through the air supply port.

Advantageous Effects of Invention

According to the present invention, the air supply damper is brought into the closed state simultaneously with completion of high-frequency heating of the food product or immediately before or immediately after the completion. As a result, outflow of water vapor from the heating chamber through the air supply port can be prevented.

DESCRIPTION OF EMBODIMENTS

Figure 1:
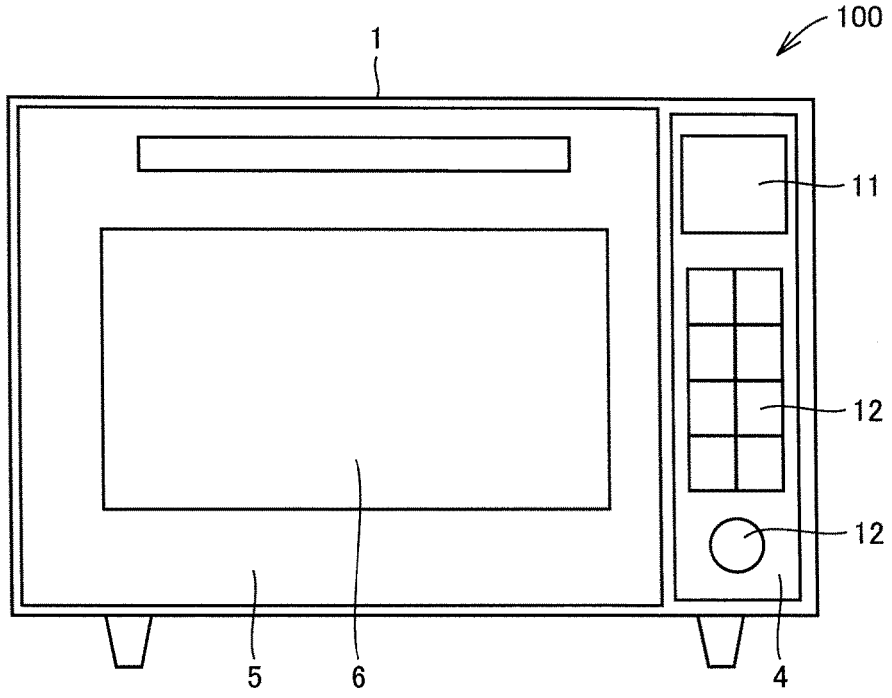
FIG. 1 is a front view of a heating cooking device 100 according to a first embodiment of the present invention.

Embodiments of the present invention will be described in detail hereinafter with reference to the drawings. The same reference numerals are assigned to the same or corresponding portions, and description thereof will not be repeated.

First Embodiment

Configuration of Heating Cooking Device

FIG. 1 is a front view of a heating cooking device 100 according to a first embodiment of the present invention.

Figure 2:
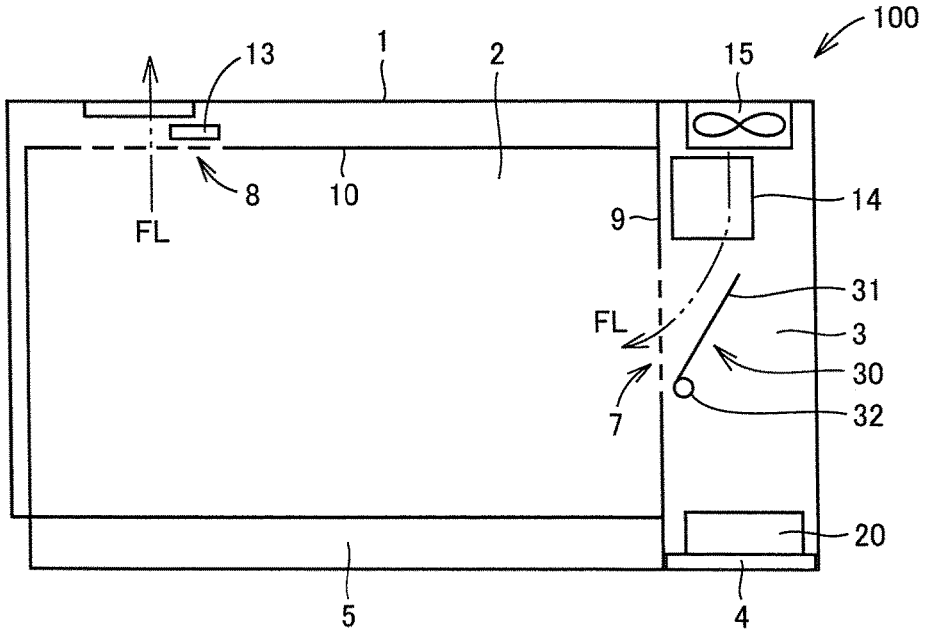
FIG. 2 is an upper cross-sectional view schematically showing an internal structure of heating cooking device 100.

FIG. 2 is an upper cross-sectional view schematically showing an internal structure of heating cooking device 100.

Figure 3:
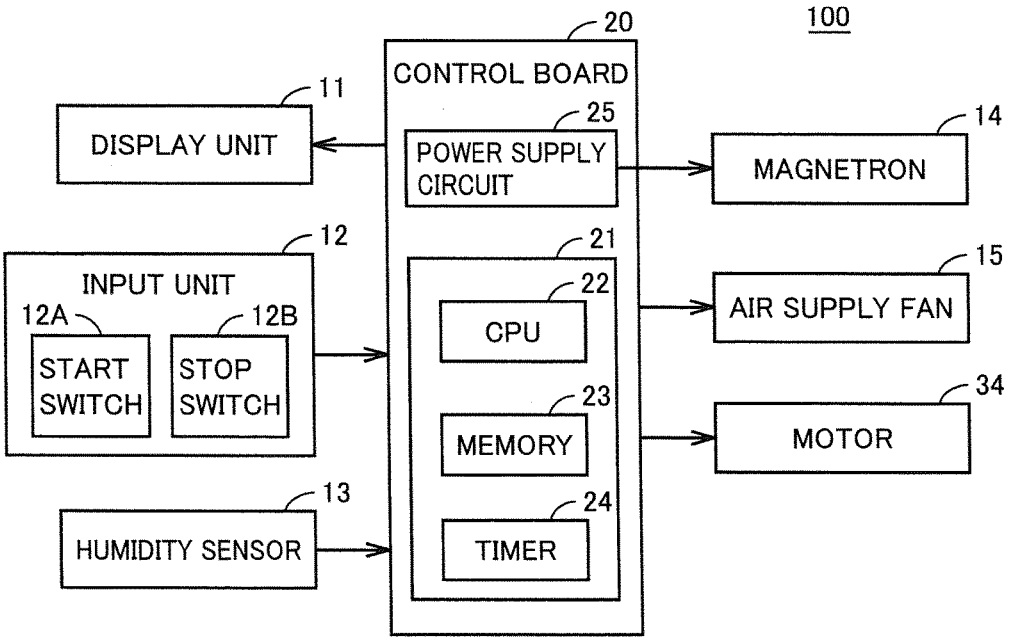
FIG. 3 is a block diagram showing a configuration of heating cooking device 100.

FIG. 3 is a block diagram showing a configuration of heating cooking device 100. The configuration of heating cooking device 100 will be described below. Although heating cooking device 100 is described as a cooking device exclusively for high-frequency (in particular, microwave) heating, the present invention is also applicable to heating cooking devices that can perform oven heating, water vapor heating or the like in addition to high-frequency heating.

Heating Chamber

Referring to FIGS. 1 and 2, a heating chamber 2 having a front surface opened to house a food product is provided within a cabinet 1 of heating cooking device 100. A front door 5 is pivotably attached to the front surface opening of heating chamber 2. Front door 5 is provided with a windowpane 6 such that the inside of heating chamber 2 can be visually checked.

Display Unit and Input Unit

When viewed from the front of heating cooking device 100, an operation panel 4 is provided on the right side of front door 5. Operation panel 4 is provided with a display unit 11 for displaying the heating time and the like during heating cooking, and an input unit 12 for allowing the user to input an operation mode (e.g., normal heating, thawing of frozen food, heating of sake, and the like), an output of a magnetron 14, the cooking time, and the like. Input unit 12 also includes a start switch 12A for starting heating cooking, and a stop switch 12B for stopping heating cooking.

Machine Chamber

As shown in FIG. 2, a machine chamber 3 is further provided within cabinet 1. In the example of this embodiment, machine chamber 3 is provided on the right side of heating chamber 2. An air supply port 7 is provided in a partition wall that separates heating chamber 2 and machine chamber 3.

Magnetron (high-frequency wave generating device) 14 that generates a high-frequency wave, an air supply fan 15, an air supply damper 30, a control board 20 and the like are provided in machine chamber 3.

Air Supply Fan

Air supply fan 15 generates cooling wind for cooling magnetron 14. A part of the cooling wind is also used to cool control board 20.

When the food product is being heated with the high-frequency wave, cooling wind FL having cooled magnetron 14 is introduced into heating chamber 2 through air supply port 7. The purpose of this is to push out, to the outside of heating chamber 2, a large amount of water vapor generated from the food product during high-frequency heating. By introducing cooling wind FL through air supply port 7, the air inside heating chamber 2 is discharged outside heating chamber 2 through an exhaust port 8 provided at the rear part of heating chamber 2, together with the water vapor.

A humidity sensor 13 is provided on the outer side of exhaust port 8, and humidity sensor 13 can detect an amount of the water vapor, thereby detecting the heating state of the food product.

Air Supply Damper

Air supply damper 30 is for opening and closing air supply port 7. During high-frequency heating, a lid 31 of air supply damper 30 is opened, such that cooling wind FL is guided into heating chamber 2 through air supply port 7.

Figure 4A:
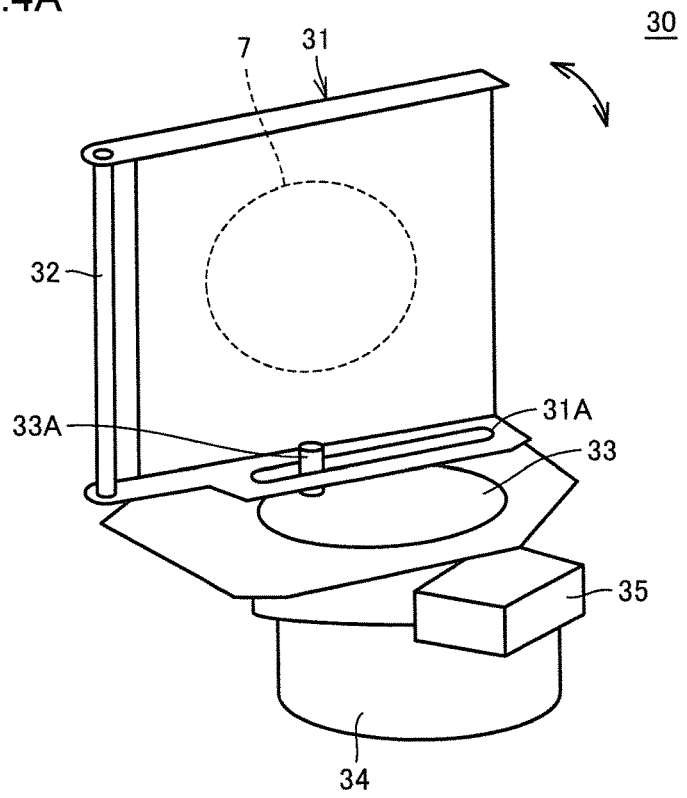
FIG. 4A is a perspective view showing one example of a structure of an air supply damper 30 (state in which an air supply port 7 is closed).
Figure 4B:
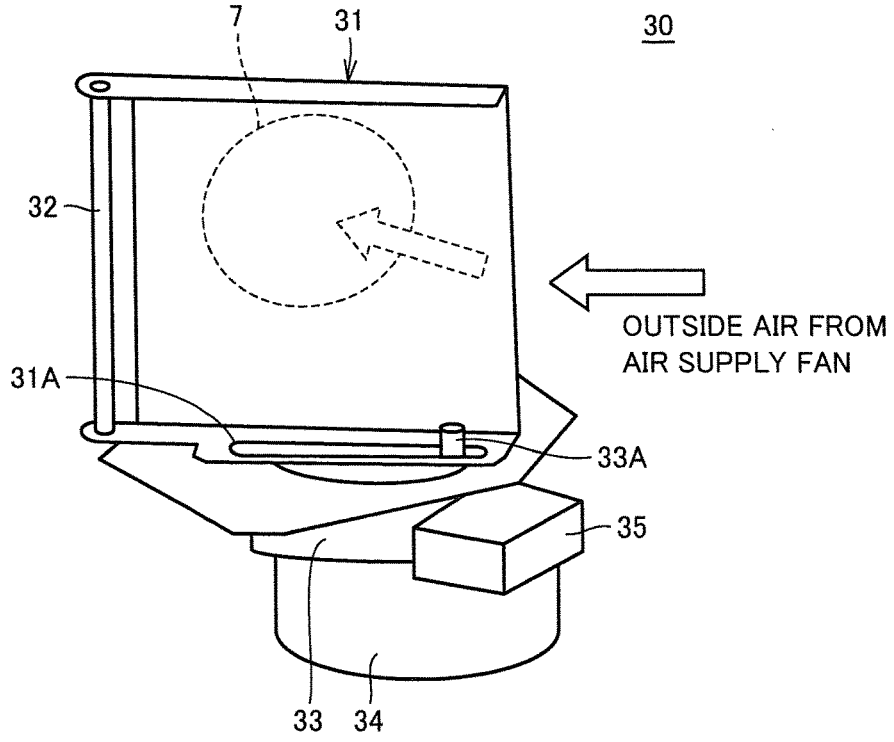
FIG. 4B is a perspective view showing one example of the structure of air supply damper 30 (state in which air supply port 7 is opened).

FIGS. 4A and 4B are perspective views showing one example of a structure of air supply damper 30. FIG. 4A shows a state in which air supply port 7 is closed, and FIG. 4B shows a state in which air supply port 7 is opened.

Referring to FIGS. 4A and 4B, air supply damper 30 includes a motor 34, a circular disc-like cam 33 attached to a rotation shaft of the motor, a switch 35, and lid 31. A side end of lid 31 is pivotably supported by a support shaft 32. A slide groove 31A is provided at the lower part of lid 31. With rotation of motor 34, a protruding portion 33A provided on circular disc-like cam 33 slides within slide groove 31A, and thereby, lid 31 is opened and closed. Circular disc-like cam 33 turns on and off switch 35, and thereby, the position of lid 31 is detected.

Control Board

Referring again to FIGS. 1 to 3, control board 20 is provided within machine chamber 3 (on the rear surface side of operation panel 4). Control board 20 is connected to previously-described display unit 11, input unit 12, humidity sensor 13, magnetron 14, air supply fan 15, motor 34 and the like. A microcomputer chip 21 that executes overall control, a power supply circuit 25 that supplies a driving voltage to magnetron 14, and the like are installed on control board 20. Microcomputer chip 21 includes a CPU (Central Processing Unit) 22, a memory 23, a timer 24 and the like.

Procedure of Heating Cooking by High-Frequency Heating

Figure 5:
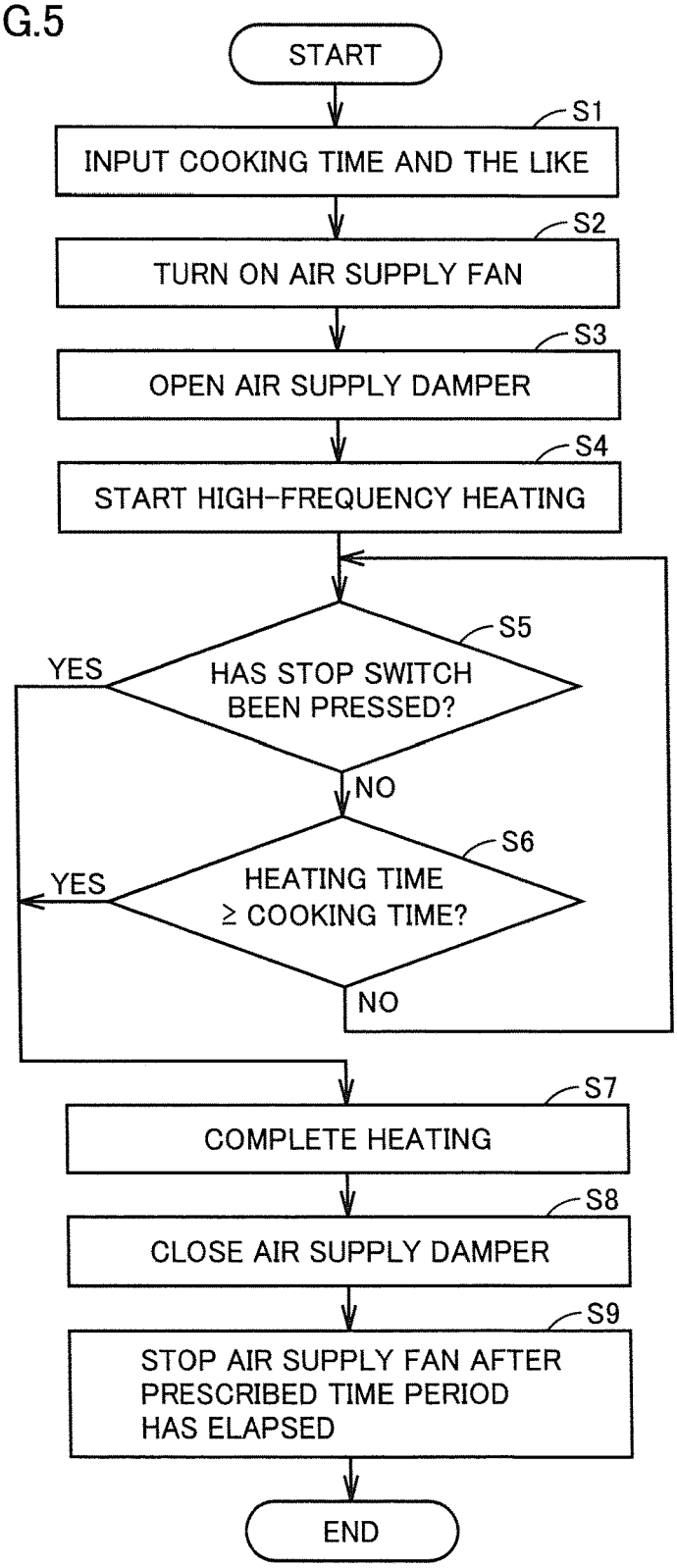
FIG. 5 is a flowchart showing a procedure of heating cooking by heating cooking device 100.

FIG. 5 is a flowchart showing a procedure of heating cooking by heating cooking device 100. Each step shown in FIG. 5 is executed by CPU 22 in FIG. 3 operating in accordance with a program read from memory 23.

Referring to FIGS. 3 and 5, first, in step S1, the operation mode, the cooking time and the like are inputted to input unit 12. CPU 22 stores the inputted operation mode, cooking time and the like into memory 23.

In the next step S2, CPU 22 turns on air supply fan 15. In the next step S3, CPU 22 drives motor 34 and brings air supply damper 30 into the open state.

In the next step S4, CPU 22 turns on magnetron 14 and starts heating cooking with the high-frequency wave. This heating cooking is continued until a result of determination in either one of the next steps S5 and S6 becomes YES.

In step S5, CPU 22 determines whether stop switch 12B provided in input unit 12 has been pressed or not. If stop switch 12B has been pressed (YES in step S5), CPU 22 moves the process to step S7 and the subsequent steps.

In step S7, CPU 22 turns off magnetron 14 and stops heating cooking, and immediately after that, CPU 22 brings air supply damper 30 into the closed state (step S8). Thereafter, when a prescribed time period has elapsed, air supply fan 15 is stopped (step S9).

On the other hand, if stop switch 12B is not pressed (NO in step S5), CPU 22 determines in step S6 whether a time period from the start of heating (heating time) has become equal to or longer than the cooking time inputted in step S1. The heating time is measured by timer 24 built into microcomputer chip 21.

If stop switch 12B is not pressed (NO in step S5) and the heating time has reached the set cooking time (YES in step S6), CPU 22 performs the already-described process in step S7 and the subsequent steps. Specifically, in step S7, CPU 22 turns off magnetron 14 and stops heating cooking, and immediately after that, CPU 22 brings air supply damper 30 into the closed state (step S8). Thereafter, when the prescribed time period has elapsed, air supply fan 15 is stopped (step S9). Then, the procedure of heating cooking with the high-frequency wave is completed.

The aforementioned procedure of heating cooking is characterized in that air supply damper 30 is brought into the closed state immediately after heating cooking is stopped.

If air supply damper 30 is not brought into the closed state immediately after heating cooking with the high-frequency wave is stopped, the following problem may occur. Specifically, if supply of an external power supply voltage to heating cooking device 100 is stopped (e.g., removal of an AC plug from a wall outlet, and the like) after heating cooking is stopped, air supply fan 15 is turned off, with air supply damper 30 maintained in the open state. When heating cooking device 100 enters the aforementioned state before front door 5 of heating cooking device 100 is opened to take out the food product, such a problem occurs that the water vapor generated from the food product and accumulating in heating chamber 2 during high-frequency heating flows into machine chamber 3 through air supply port 7, which causes condensation on water-vulnerable control board 20 and the like.

In heating cooking device 100 according to the first embodiment, air supply damper 30 is brought into the closed state immediately after heating cooking with the high-frequency wave is stopped. Therefore, even if the external power supply is shut off before front door 5 is opened, flow of the water vapor from heating chamber 2 through air supply port 7 into machine chamber 3 can be prevented.

In the procedure at the start of heating in FIG. 5, air supply fan 15 is turned on and air supply damper 30 is brought into the open state before the start of heating. However, air supply fan 15 may be turned on and air supply damper 30 may be brought into the open state simultaneously with the start of heating or immediately after the start. In other words, heating chamber 2 may only be ventilated at least in most of the time period during which high-frequency heating is performed.

In the procedure at the completion of heating in FIG. 5, air supply damper 30 is brought into the closed state immediately after the completion of heating. However, air supply damper 30 may be brought into the closed state simultaneously with the completion of heating or immediately before the completion of heating. For example, air supply damper 30 may be brought into the closed state several seconds before the heating time reaches the set cooking time.

Second Embodiment

In heating cooking device 100 according to the first embodiment, when the external power supply is suddenly shut off due to removal of the AC plug from the wall outlet and the like during heating cooking with the high-frequency wave, air supply fan 15 is turned off, with air supply damper 30 maintained in the open state. As a result, the water vapor generated from the food product and accumulating in heating chamber 2 during high-frequency heating flows into machine chamber 3 through air supply port 7, which causes condensation in control board 20 and the like.

In a heating cooking device 100A according to a second embodiment, flow of the water vapor from heating chamber 2 through air supply port 7 into machine chamber 3 can be prevented even in such a case. The following is a specific description thereof.

Figure 6:
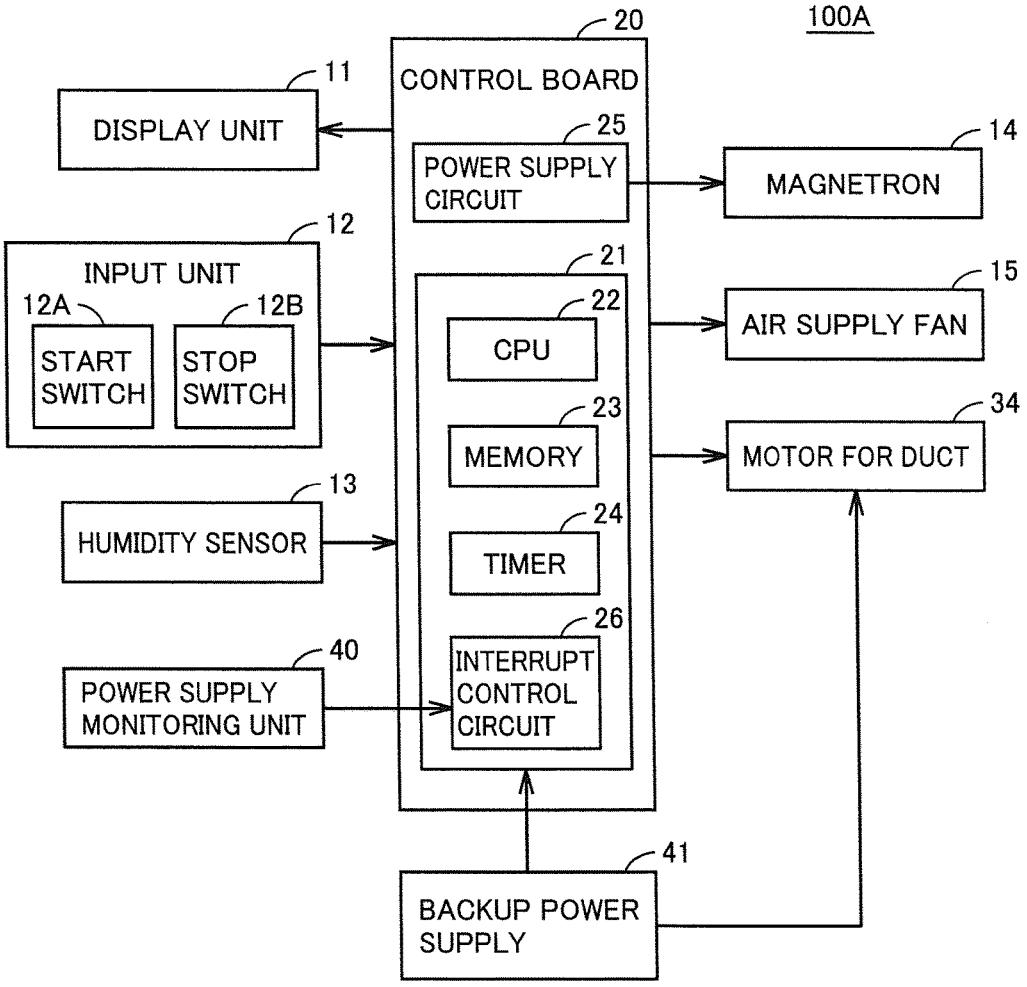
FIG. 6 is a block diagram showing a configuration of a heating cooking device 100A according to a second embodiment of the present invention.

FIG. 6 is a block diagram showing a configuration of heating cooking device 100A according to the second embodiment of the present invention. Heating cooking device 100A in FIG. 6 is different from heating cooking device 100 in FIG. 3 in that heating cooking device 100A further includes a power supply monitoring unit 40 and a backup power supply 41.

Power supply monitoring unit 40 detects stop of supply of the external power supply voltage, and notifies an interrupt control circuit 26 of microcomputer chip 21 about the result of detection. When receiving the notification of stop of the external power supply from power supply monitoring unit 40, interrupt control circuit 26 issues an interrupt request to CPU 22. In response to the interrupt request, CPU 22 brings air supply damper 30 into the closed state.

Backup power supply 41 is provided to supply power for a prescribed time period to microcomputer chip 21 and motor 34 for driving air supply damper 30, when supply of the external power supply voltage is stopped. As a result, air supply port 7 can be closed by air supply damper 30. A battery, a capacitor and the like can be used as backup power supply 41.

Since the remaining points in FIG. 6 are similar to those in FIG. 3, the same reference numerals are assigned to the same or corresponding portions and description will not be repeated.

Figure 7:
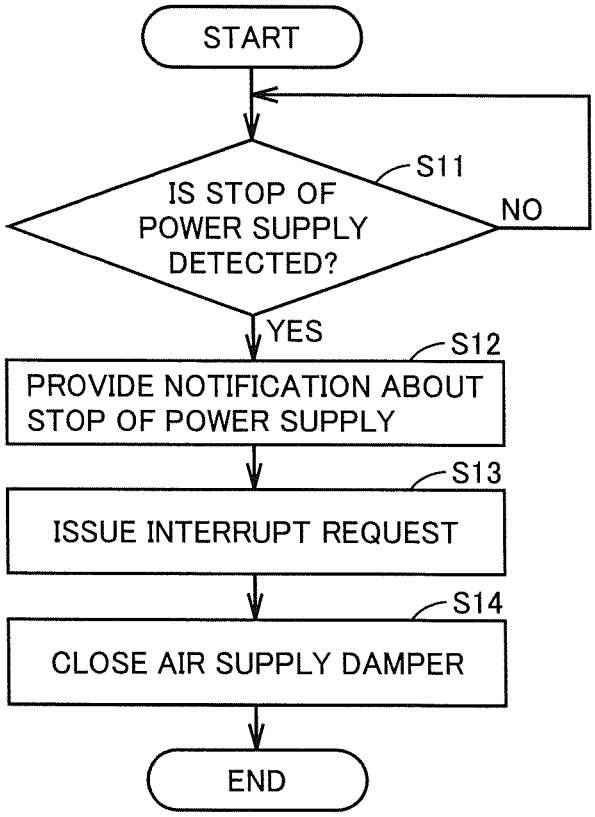
FIG. 7 is a flowchart showing an operation of heating cooking device 100A when stop of supply of an external power supply voltage is detected by a power supply monitoring unit 40.

FIG. 7 is a flowchart showing an operation of heating cooking device 100A when stop of supply of the external power supply voltage is detected by power supply monitoring unit 40. In FIG. 7, it is assumed that heating cooking with the high-frequency wave in step S4 and the subsequent steps described with reference to FIG. 5 is in execution.

Referring to FIGS. 6 and 7, if power supply monitoring unit 40 detects stop of power supply (YES in step S11), power supply monitoring unit 40 notifies interrupt control circuit 26 about the stop of power supply (step S12). In response to this notification about the stop of power supply, interrupt control circuit 26 issues an interrupt request to CPU 22 (step S13). CPU 22 having received the interrupt request caused by the stop of the external power supply brings air supply damper 30 into the closed state. As a result, flow of the water vapor from heating chamber 2 through air supply port 7 into machine chamber 3 can be prevented.

It should be understood that the embodiments disclosed herein are illustrative and not limitative in any respect. The scope of the present invention is defined by the terms of the claims, rather than the description above, and is intended to include any modifications within the scope and meaning equivalent to the terms of the claims.

REFERENCE SIGNS LIST

2 heating chamber; 3 machine chamber; 5 front door; 7 air supply port; 8 exhaust port; 11 display unit; 12 input unit; 12A start switch; 12B stop switch; 14 magnetron; 15 air supply fan; 20 control board; 21 microcomputer chip; 22 CPU; 23 memory; 24 timer; 26 interrupt control circuit; 30 air supply damper; 31 lid; 40 power supply monitoring unit; 41 backup power supply; 100, 100A heating cooking device.

The invention claimed is:

1. A heating cooking device, comprising:

a heating chamber for housing a food product;

a high-frequency wave generator that generates a high-frequency wave that heats said food product;

a machine chamber provided adjacent to said heating chamber;

an air supply port provided in a partition wall that separates said heating chamber and said machine chamber;

an air supply fan provided in said machine chamber, for supplying air to said heating chamber through said air supply port;

an air supply damper provided in said machine chamber, for opening and closing said air supply port; and a controller, provided in said machine chamber, that controls operation of said high-frequency wave generator, said air supply fan, and said air supply damper, wherein said controller is configured to drive said air supply fan and bring said air supply damper into an open state during high-frequency heating of said food product, and bring said air supply damper into a closed state simultaneously with completion of high-frequency heating of said food product or immediately before or immediately after the completion.

2. The heating cooking device according to claim 1, further comprising:

an input that accepts an instruction for stopping heating of said food product, and wherein said controller is further configured to stop, upon receiving the stop instruction during high-frequency heating of said food product, said high-frequency wave generator and bring said air supply damper into the closed state.

3. The heating cooking device according to claim 1, further comprising:

a power supply monitor that monitors a supply state of an external power supply; and a backup power supply configured to supply power for a prescribed time period; when the external power supply is stopped, and wherein said controller is further configured to bring said air supply damper into the closed state using the backup power supply when stop of the external power supply is detected by said power supply monitor during high-frequency heating of said food product.

4. The heating cooking device according to claim 1, wherein said high-frequency wave generator is provided in said machine chamber, and wind delivered from said air supply fan is used to cool said high-frequency wave generator, and the wind having cooled said high-frequency wave generator is introduced into said heating chamber through said air supply port.

5. A method for controlling a heating cooking device, said heating cooking device including:

a heating chamber for housing a food product;

a high-frequency wave generator that generates a high-frequency wave that heats said food product;

a machine chamber provided adjacent to said heating chamber;

an air supply port provided in a partition wall that separates said heating chamber and said machine chamber;

an air supply fan provided in said machine chamber, for supplying air to said heating chamber through said air supply port;

an air supply damper provided in said machine chamber, for opening and closing said air supply port; and a controller, provided in said machine chamber; that controls said heating cooking device, said method comprising the steps of:

starting high-frequency heating, turning on said air supply fan, and bringing said air supply damper into an open state, based on an instruction for starting high-frequency heating of said food product;

stopping high-frequency heating of said food product when a prescribed cooking time period has elapsed; and bringing said air supply damper into a closed state simultaneously with an elapse of said cooking time period or immediately before or immediately after the elapse of said cooking time period.

6. The method for controlling the heating cooking device according to claim 5, further comprising the step of:

stopping high-frequency heating and bringing said air supply damper into the closed state, when receiving an instruction for stopping heating during high-frequency heating of said food product.

7. The method for controlling the heating cooking device according to claim 5, further comprising the steps of:

monitoring a supply state of an external power supply; and bringing said air supply damper into the closed state by power supply from a backup power supply when stop of the external power supply is detected during high-frequency heating of said food product.

* * * * *